US008844088B2

(12) United States Patent
Garcia Castillo

(10) Patent No.: US 8,844,088 B2
(45) Date of Patent: Sep. 30, 2014

(54) SPRAY MOP

(71) Applicant: Hevert Adolfo Garcia Castillo, Guatemala C.A. (GT)

(72) Inventor: Hevert Adolfo Garcia Castillo, Guatemala C.A. (GT)

( * ) Notice: Subject to any disclaimer, the term of this patent is extended or adjusted under 35 U.S.C. 154(b) by 24 days.

(21) Appl. No.: 13/739,293

(22) Filed: Jan. 11, 2013

(65) Prior Publication Data

US 2014/0196233 A1 Jul. 17, 2014

(51) Int. Cl.
*A47L 13/24* (2006.01)
*A47L 13/22* (2006.01)

(52) U.S. Cl.
CPC ..... *A47L 13/22* (2013.01)
USPC ..... 15/150; 15/229.6; 401/138

(58) Field of Classification Search
USPC ..... 15/144.1, 144.2, 147.1, 150–153, 15/229.6–229.9, 244.2; 401/137–140
See application file for complete search history.

(56) References Cited

U.S. PATENT DOCUMENTS

| | | | | |
|---|---|---|---|---|
| 35,951 | A * | 7/1862 | Reed et al. | |
| 116,174 | A * | 6/1871 | French | 15/150 |
| 116,512 | A | 6/1871 | Todd et al. | |
| 275,294 | A | 4/1883 | Titus et al. | |
| 512,543 | A | 1/1894 | Froberg et al. | |
| 659,918 | A | 10/1900 | Froberg et al. | |
| 675,449 | A | 6/1901 | Smith | |
| 696,759 | A | 4/1902 | Schmidt | |
| 1,056,963 | A * | 3/1913 | Wing | 15/150 |
| 1,171,161 | A * | 2/1916 | Wingender | 15/150 |
| 1,376,175 | A | 4/1921 | Sottdermaiw et al. | |
| 1,438,644 | A * | 12/1922 | Hill | 15/150 |
| 2,073,170 | A * | 3/1937 | Pieper | 401/138 |
| 2,568,218 | A | 9/1951 | Campbell et al. | |
| 3,187,363 | A | 6/1965 | Auwarter et al. | |
| 3,688,331 | A | 9/1972 | Saltzstein et al. | |
| 4,287,632 | A | 9/1981 | Hammond | |
| 4,863,299 | A | 9/1989 | Osberghaus et al. | |
| 5,724,696 | A * | 3/1998 | Di Giammarino | 15/150 |
| 5,876,141 | A * | 3/1999 | Hsu | 401/207 |
| 5,913,347 | A * | 6/1999 | Wilen | 15/115 |
| 5,918,340 | A | 7/1999 | Young | |
| 6,098,235 | A | 8/2000 | Tomm et al. | |
| 6,105,193 | A | 8/2000 | Williams et al. | |
| 6,540,424 | B1 | 4/2003 | Hall et al. | |
| 7,246,399 | B2 | 7/2007 | Petner | |
| 2004/0078911 | A1 | 4/2004 | Young | |
| 2010/0175211 | A1 | 7/2010 | Hu | |

FOREIGN PATENT DOCUMENTS

| | | | |
|---|---|---|---|
| DE | 19614380 A1 | | 10/1997 |
| JP | 8-187213 | * | 7/1996 |
| JP | 11-009536 A | | 1/1999 |
| JP | 2006-68325 | * | 3/2006 |

* cited by examiner

*Primary Examiner* — Mark Spisich
(74) *Attorney, Agent, or Firm* — Ernesto Garcia

(57) ABSTRACT

A spray mop utilizing a latch and an auxiliary latch that prevents a hinge bar of a mop head from separating and keeping either a cloth mop or a string mop in place. The spray mop utilizes a spray mop that is activated by the use of a lever near the handle of the spray mop. In another embodiment, the hinge bar just uses a latch without an auxiliary latch.

20 Claims, 3 Drawing Sheets

SPRAY MOP

BACKGROUND OF THE INVENTION

Spray mops have been around in the past of which many implement a pad or cloth. In order to keep the cloth in place, the head of the mop is equipped with a retaining system that utilizes a latch or lock. The user then places the cloth in place and a portion of the retaining system hinges thus locking the cloth between the head and the retaining system. In other words, the cloth becomes sandwiched between the retaining system and the head of the mop. The latch or lock prevents the retaining system from separating away from the head. Those that use the pad, the pad is either glued or connected via hook and loops to the head without the use of a retaining system.

SUMMARY OF THE INVENTION

The invention is a mop that utilizes a retaining system that hinges and becomes retained with one latch or a combination of a latch and an auxiliary latch. In the embodiment using one latch, the user applies pressure on the retaining system which comprises a hinged bar so that the latch rides over a hook while the user applies pressure. In the second embodiment, the retaining system integrates the auxiliary latch as part of the hinged bar which provides a primary connection that hooks to the mop head. Once hooked to the mop head, the hinged bar will be securely locked with the latch that hooks to the hinged bar.

The invention provides a style of using old technology with improvements. The head of the mop is designed to obtain a cloth or a string mop and the mop contains a spray system such that a user can pull a lever to activate the spray. The spray can either be set manually or electronically.

DETAILED DESCRIPTION OF THE INVENTION

Figure 1:
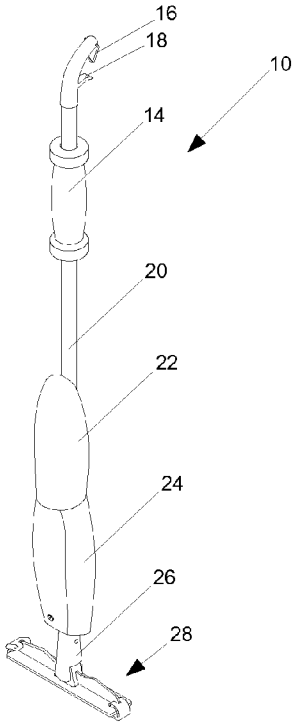
FIG. 1 shows an isometric view of a spray mop.
Figure 2:
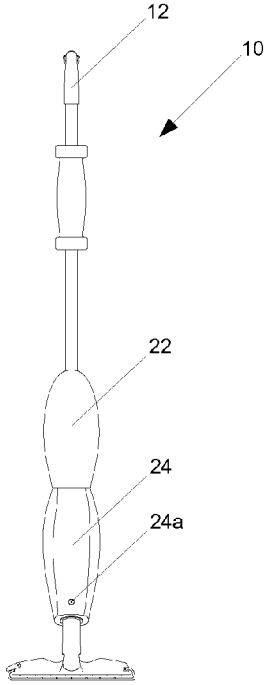
FIG. 2 shows a front view of the spray mop.
Figure 3:
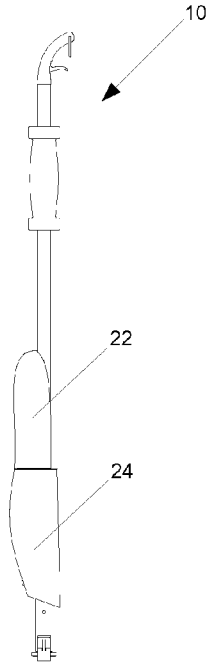
FIG. 3 shows a right side view of the spray mop.

FIGS. 1-3 show a spray mop 10 including an improvement in holding a cloth mop or a string mop, not shown. The mop 10 includes a curved handle 12 that pivotally holds a lever 18 to activate a spray system 24 containing a nozzle 24*a*. The mop 10 further includes a pole 20 and a padded handle 14 along the pole 20 to give additional leverage in mopping those nasty stains. The mop 10 is equipped with a hook 16 so that the mop can be hung on a wall or a storage cabinet. The mop includes a removable water reservoir 22 so that one can refill the spray system 24 at will.

Figure 4:
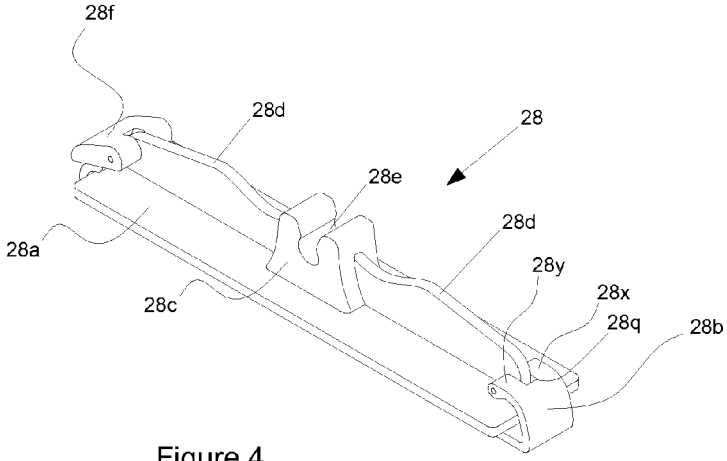
FIG. 4 shows an isometric view of the head used in the spray mop.
Figure 5:
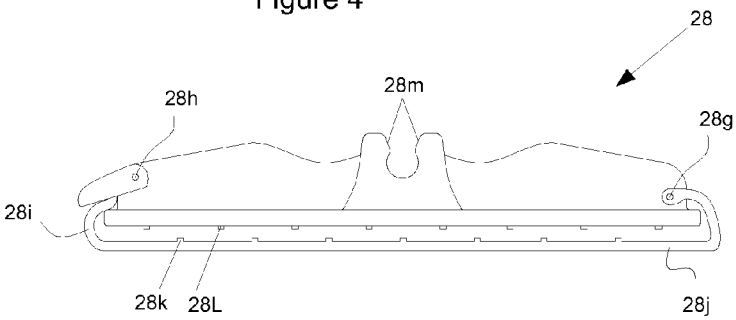
FIG. 5 shows a front view of the head shown in FIG. 4 in a locked position.
Figure 6:
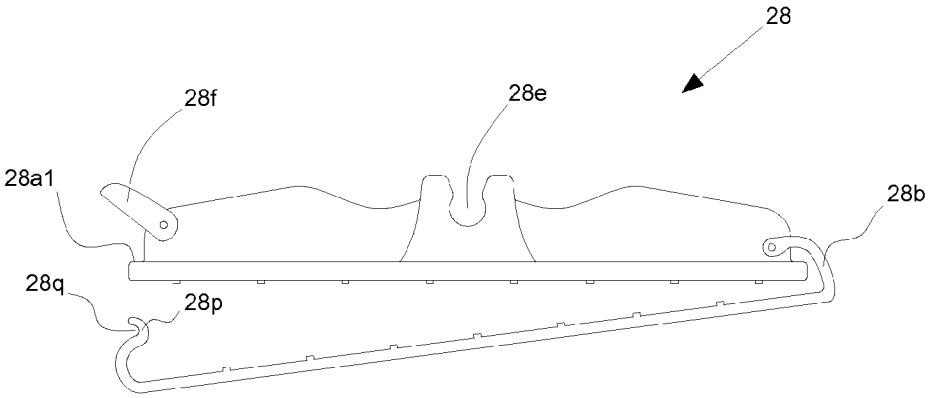
FIG. 6 shows a front view of the head show in FIG. 4 in an open position.

As shown in FIGS. 1 and 4, the mop 10 includes a first embodiment of a head 28 that pivotally connects to a fork 26 attached to the spray system 24. The fork 26 connects to one end of the pole 20. The fork 26 contains a cylindrical rod that engages a cylindrical cavity 28*e* in a post 28*c* by snap fitting. The cylindrical cavity 28*e* is guided by tapered surfaces 28*m*, which guide the cylindrical rod into the cylindrical cavity 28*e* until snap fitted and form a mouth. The head 28 is comprised of a planar base 28*a* and two opposite webs 28*d* that are next to the post 28*c* and project perpendicular to the base 28*a* along a central axis of the base 28*a*. The webs 28*d* provide rigidity to the base 28*a* and provides supportive surfaces to a retaining system 28*b* and a latch 28*f*. As seen in FIG. 5, the latch 28*f* is pivotally connected via a fastener 28*h* at one of the webs 28*d* near one end. The retaining system 28*b* comprises a hinged bar 28*j* that is pivotally connected via a fastener 28*g* at the other web 28*d* opposite to where the latch 28*f* is mounted. In the head 28, the base 28*a* extends beyond the webs 28*d* so that base 28*a* provides an extended engagement portion 28*a*1 adjacent to the latch 28*f* as seen in FIG. 6.

Figure 7:
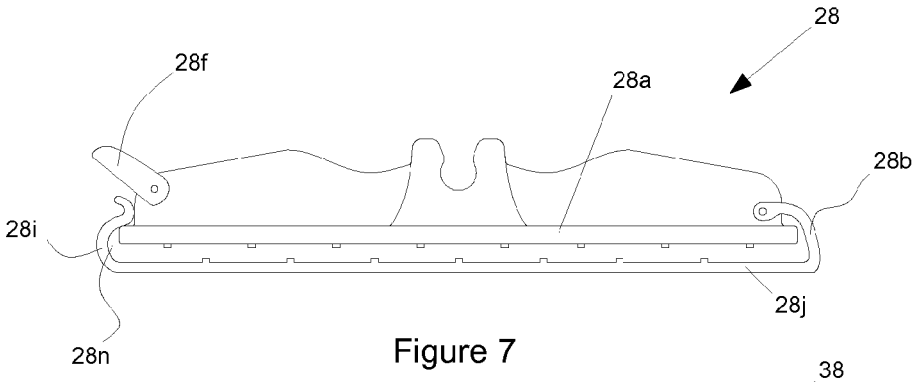
FIG. 7 shows a front view of the head shown in FIG. 4 in a semi-locked position.
Figure 14:
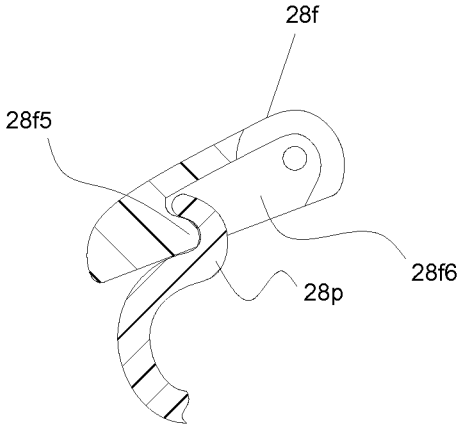
FIG. 14 shows a cross-sectional view of the latch shown fully engaged with a hook of the head.

As seen in FIGS. 5 and 7, the hinged bar 28*j* includes an auxiliary hook portion 28*i* forming an auxiliary hook cavity 28*n* that serves to engage the extended engagement portion 28*a*1 of the base 28*a*. Prior to engagement, as seen in FIG. 6, the first hook portion 28*i* is away from the base 28*a* and the auxiliary hook portion 28*i* is made flexible so that a latch hook portion 28*p* rides and expands the auxiliary hook portion 28*i* by mere leverage. As soon as the auxiliary hook cavity 28*n* engages the extended engagement portion 28*a*1, the latch 28*f* is pivoted to lock with a latch cavity 28*q* formed by the latch hook portion 28*p* as seen in FIG. 14. As shown in FIG. 6, both the hatch hook portion 28*p* and the auxiliary hook portion 28*i* combined form an S-shape in orientation or a backwards S-shape in an opposite orientation where one of the hoops of the S-shape is shorter than the other hoop.

As seen in FIGS. 10-14, the latch 28*f* comprises an elongated body that contains a through hole 28*f*1 for the fastener 28*h*. The elongated body is split, at one end, by a notch 28*f*2 forming two spaced lugs 28*f*3, 28*f*4 where the through hole 28*f*1 passes through. The same notch 28*f*2 serves to receive one of the webs 28*d* of the head 28 thus allowing the latch 28*f* to pivot. The latch 28*f* further includes a receiving cavity 28*f*6 and an inner lobe 28*f*5, which serves to engage the latch cavity 28*q*. The receiving cavity 28*f*6 serves to receive the latch hook portion 28*p*.

As shown in FIG. 4 and similar in concept to the latch 28*f*, the retaining system 28*b* contains a notch 28*q* at one end which forms two lobes 28*x*, 28*y* which bridge the bar 28*j*. The fastener 28*g* passes through the lobes 28*x*, 28*y* and through one of the webs 28*d* thus making the bar 28*j* hinged at one end of the head 28.

Figure 8:
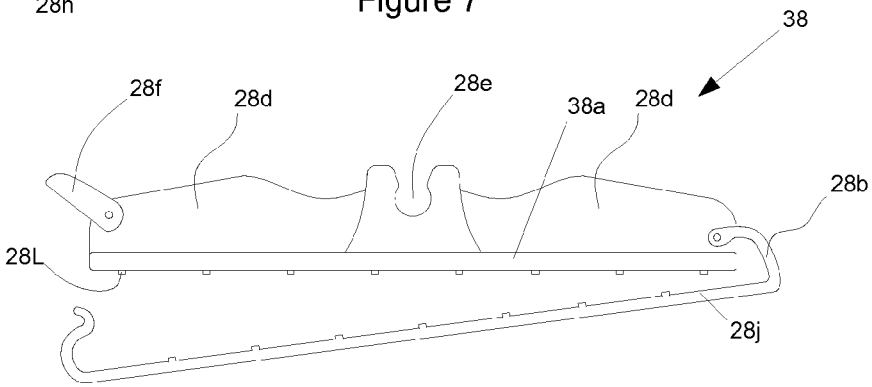
FIG. 8 shows a front view of another embodiment of the head used in the mop and in an open position.
Figure 9:
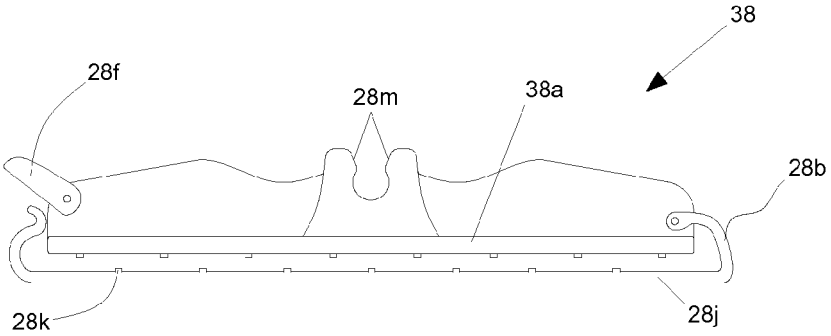
FIG. 9 shows a front view of the head shown in FIG. 8 in a transitive position.
Figure 10:
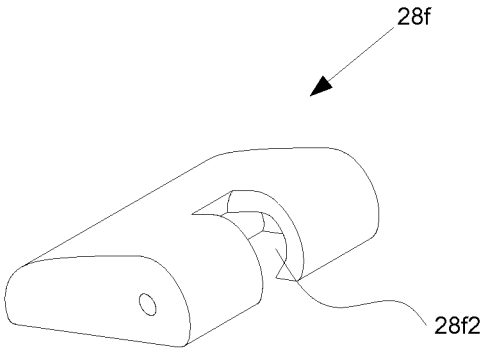
FIG. 10 shows an isometric view of the latch used in the mop head.
Figure 11:
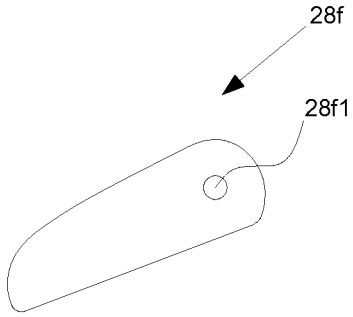
FIG. 11 shows a front view of the latch shown in FIG. 10.
Figure 12:
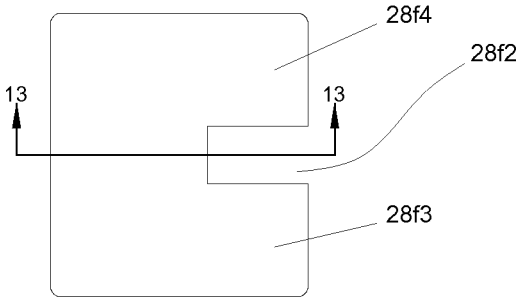
FIG. 12 shows a top view of the latch shown in FIG. 10.
Figure 13:
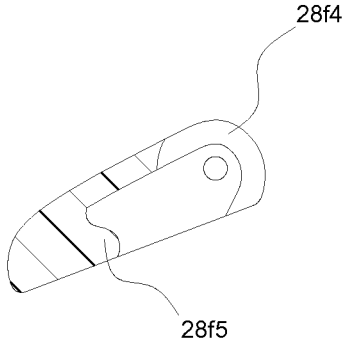
FIG. 13 shows a cross-sectional view 13-13 of the latch shown in FIG. 12.

In FIGS. 8 and 9, it shows a second embodiment of a modified head 38. In this head 38, the difference between this head 38 and the other head 28 is that the base 38*a* does not extend beyond the webs 28*d*. This eliminates the auxiliary hook cavity 28*n* of the retaining system 28*b* from engaging with an extended engagement portion 28*a*1 of the base 28*a* as shown in the head 28. See FIG. 7. While the elimination of the extended engagement portion 28*a*1 in base 38*a* reduces a locking action, the latch 28*f* will provide sufficient locking of the hinged bar 28*j* as shown in FIG. 14.

The invention has been described above to be improvements of the mop or mop head. The bases 28*a*, 38*a* and the bar 28*j* can respectively contain elongated grippers 28L, 28*k* to grasp the cloth mop or the string mop but are not necessary. While the spray system 24 is not the improvement, the spray system 24 is envisioned manually operated or electronically operated. In the manual operated mode, a cable will be attached to the lever 18 which will then mechanically activate the spray system. In the electronically operated mode, the lever 18 will push a button thus electronically activating the spray system. While the materials that make the spray mop have not been detailed, it is envisioned that the spray mop can be made from plastic or a combination of plastics and metals. Of course, obvious material modifications can be made to reduce the weight and cost. Further, while the mop 10 contains a spray system 24, it is envisioned that the spray system 24 can be eliminated to reduce price cost in manufacturing.

The invention claimed is:

1. A mop comprising a pole, a handle, and a mop head;

the pole connecting with a fork pivotable with the mop head;

the mop head comprising a planar base, a pair of webs extending perpendicular to the base, and a bar that hinges at one end of one of the webs; and, wherein a latch is pivotally connected to the other of the webs at one end and includes an inner lobe to be connected with a latch cavity formed by a latch hook portion that is integral at one end of the bar.

2. The mop as claimed in claim 1, wherein the bar further includes an integral auxiliary hook cavity formed by an auxiliary hook portion; and, wherein the latch cavity faces the bar and the auxiliary hook cavity faces opposite the latch cavity.

3. The mop as claimed in claim 2, wherein the auxiliary hook portion and the latch hook portion forms an S-shape having a top hoop of the S-shape smaller than a bottom hoop of the S-shape.

4. The mop as claimed in claim 3, wherein the base of the head further includes an engagement portion extending beyond one of the webs and the auxiliary hook cavity engages with the engagement portion.

5. The mop as claimed in claim 1, wherein the latch comprises a slot at one end forming a pair of opposed lugs, an internal cavity, and an opening extending through the lugs; and wherein a fastener extends through the opening and through one of the webs.

6. The mop as claimed in claim 5, wherein the bar comprises a slot at one end forming a pair of opposed lugs that bridges the bar over the base of the head; and, wherein an opening extends through the pair of opposed lugs of the bar and a fastener extends through the opening of the lugs of the bar and through the other web.

7. The mop as claimed in claim 6, wherein the base and the bar each including a series of grippers.

8. The mop as claimed in claim 6, wherein the mop further comprises a spray system and a lever that interacts with the spray system.

9. The mop as claimed in claim 1, wherein a post extends perpendicular to the base and contains a cylindrical cavity extending perpendicular to the post; and wherein the webs extend from the post.

10. The mop as claimed in claim 9, wherein the cylindrical cavity adjoins a mouth defined by a pair of opposed tapered surfaces.

11. A mop head comprising a planar base, a pair of webs extending perpendicular to the base, and a bar that hinges at one end of one of the webs; and, wherein a latch is pivotally connected to the other of the webs at one end and includes an inner lobe to be connected with a latch cavity formed by a latch hook portion that is integral at one end of the bar.

12. The mop head as claimed in claim 11, wherein the bar further includes an integral auxiliary hook cavity formed by an auxiliary hook portion; and, wherein the latch cavity faces the bar and the auxiliary hook cavity faces opposite the latch cavity.

13. The mop head as claimed in claim 12, wherein the auxiliary hook portion and the latch hook portion forms an S-shape having a top hoop of the S-shape smaller than a bottom hoop of the S-shape.

14. The mop head as claimed in claim 13, wherein the base of the head further includes an engagement portion extending beyond one of the webs and the auxiliary hook cavity engages with the engagement portion.

15. The mop head as claimed in claim 11, wherein the latch comprises a slot at one end forming a pair of opposed lugs, an internal cavity, and an opening extending through the lugs; and wherein a fastener extends through the opening and through one of the webs.

16. The mop head as claimed in claim 15, wherein the bar comprises a slot at one end forming a pair of opposed lugs that bridges the bar over the base of the head; and, wherein an opening extends through the pair of opposed lugs of the bar and a fastener extends through the opening of the lugs of the bar and through the other web.

17. The mop head as claimed in claim 16, wherein the base and the bar each including a series of grippers.

18. The mop head as claimed in claim 11, wherein a post extends perpendicular to the base and contains a cylindrical cavity extending perpendicular to the post; and wherein the webs extend from the post.

19. The mop head as claimed in claim 18, wherein the cylindrical cavity adjoins a mouth defined by a pair of opposed tapered surfaces.

20. A mop head comprising a mop base, a pair of webs extending perpendicular to the base, and a bar that hinges at one end of one of the webs;

wherein a latch is pivotally connected to the other of the webs at one end and includes an inner lobe to be connected with a latch cavity formed by a latch hook portion that is integral at one end of the bar;

wherein the bar further includes an integral auxiliary hook cavity formed by an auxiliary hook portion; and, wherein the latch cavity faces the bar and the auxiliary hook cavity faces opposite the latch cavity.

* * * * *